United States Patent [19]

Klein

[11] 3,935,819

[45] Feb. 3, 1976

[54] MASS TRANSPORTATION

[76] Inventor: Bradley R. Klein, 855 Piccadilly Circle, Sacramento, Calif. 95825

[22] Filed: May 7, 1974

[21] Appl. No.: 463,068

[52] U.S. Cl. ..... 104/23 FS; 104/134

[51] Int. Cl.[2] ..... B61D 15/00

[58] Field of Search ..... 104/23 FS, 134, 138 R, 104/148 LM, 148 MS, 155, 156; 180/115

[56] References Cited

UNITED STATES PATENTS

| | | | |
|---|---|---|---|
| 425,408 | 4/1890 | Craw | 104/23 FS |
| 465,151 | 12/1891 | Barre | 104/23 FS |
| 3,338,175 | 8/1967 | Hardy et al. | 104/134 X |
| 3,373,697 | 3/1968 | Hartje | 104/23 FS |
| 3,543,685 | 12/1970 | Rosciszewski | 104/23 FS |
| 3,648,620 | 3/1972 | Bertin et al. | 104/23 FS X |

FOREIGN PATENTS OR APPLICATIONS

| | | | |
|---|---|---|---|
| 1,138,317 | 1/1969 | United Kingdom | 104/23 FS |

*Primary Examiner*—M. Henson Wood, Jr.
*Assistant Examiner*—Andres Kashnikow

[57] ABSTRACT

A method of high speed mass transportation. A vehicle with a substantially flat bottom traverses a substantially flat track which is covered with a layer of liquid, whereupon the vehicle "hydroplanes" over the track.

4 Claims, 10 Drawing Figures

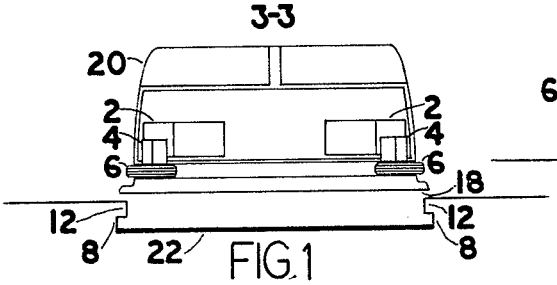
FIG.1
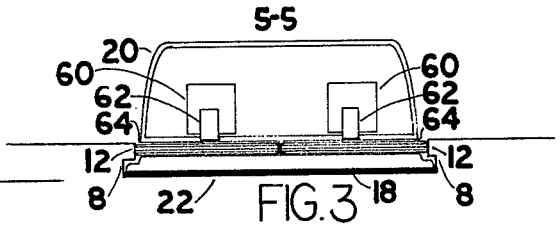
FIG.3
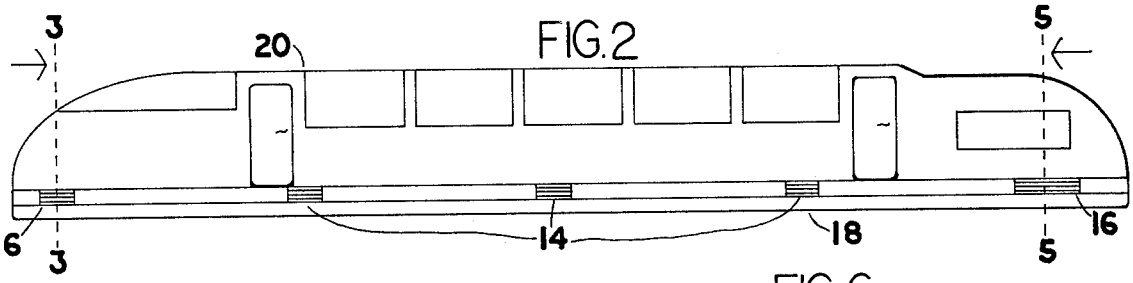
FIG.2
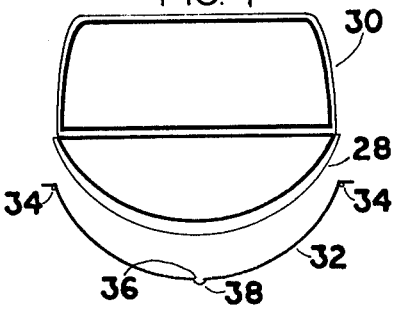
FIG.4
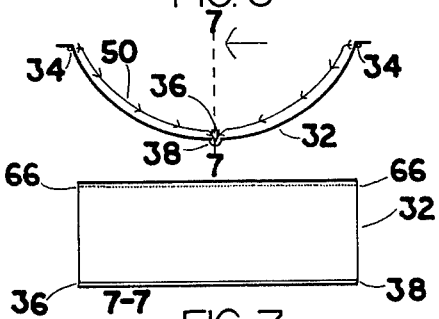
FIG.6
FIG.7
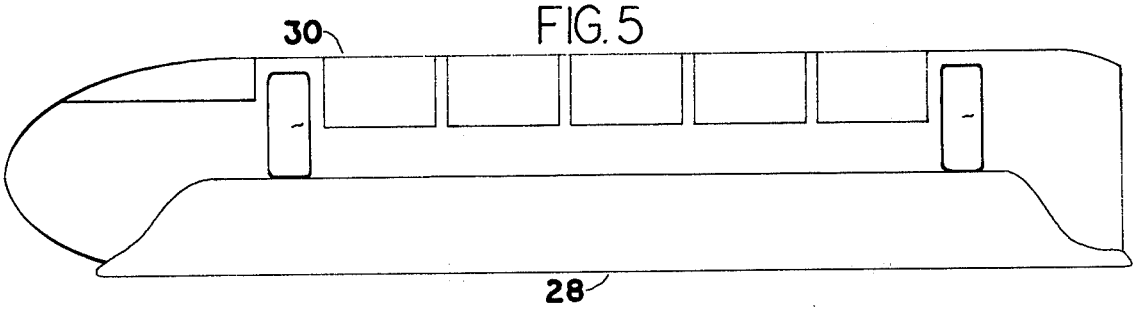
FIG.5
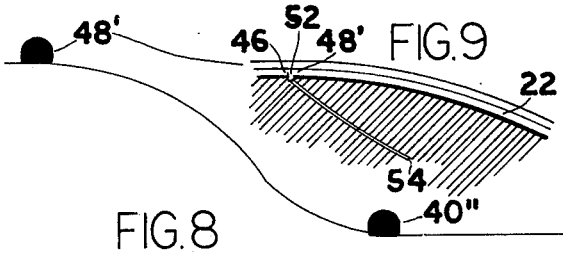
FIG.9
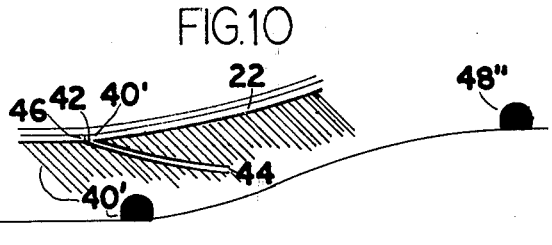
FIG.10
FIG.8

MASS TRANSPORTATION

BACKGROUND OF THE INVENTION

Field of the Invention and Description of the Prior Art

This invention relates to a method of high speed mass transportation, specifically a design for a track and the bottom supportive structure of a vehicle, so they combine to reduce the friction which impedes a vehicles forward progress, and they further combine to provide support and direction to the vehicle.

Since the passenger carrying capacity of air travel is limited by subsonic speeds and saturated air corridors, and since the only forms of ground transportation are wheeled, with all its limitations, such as a maximum speed of about 200 m.p.h. for trains, many of the major countries of the world are looking for and developing alternatives to the wheel for high speed mass transportation.

Two of the most promising types of wheelless ground transportation so far devised are electromagnetic flight and the tracked air cushion vehicle.

The tracked air cushion vehicle seems to have a very limited potential since it requires an expensive, concrete, U shaped track, and the vehicle also disrupts the immediate area of its passing with turbulant air, thus increasing the required width of the right of way.

The main disadvantage of electromagnetic flight is that the involved technology is relatively new, so the problems which can be expected to crop up will very possibly increase the cost of development and construction greatly.

SUMMARY OF THE INVENTION

It is therefore and important object of this invention to provide a method of high speed mass transportation which is particularly useful for reducing the friction which hinders a vehicle's forward progress.

It is also an object of this invention to provide support and direction to the high speed mass transportation vehicle.

It is a further object of this invention to provide a method of high speed mass transportation which is particularly characterized by its simplicity and economy in construction and operation.

It is still another object of this invention to provide a method of high speed mass transportation wherein the method generally comprises a vehicle with a substantially flat bottom which hydroplanes over a substantially flat track which is covered with a film of liquid.

Another form my invention could take is wherein the method generally comprises a vehicle with a substantially U shaped bottom which traverses a substantially U shaped track, which is covered with a film of liquid, wherein the liquid comes from apertures spaced along a tube which follows the upper edges of the track, the liquid subsequently escaping the track through a one inch slit which follows the lowest points of the track.

Further purposes and objects of this invention will appear as the specifications proceed.

BRIEF DESCRIPTION OF THE DRAWING

Referring to the drawings, two particular embodiments of the present invention are illustrated, wherein;

FIG. 1 is a cross-sectional view of a possible embodiment of my novel method of high speed mass transportation, both vehicle and track, the vehicle being elevated above the track, and also seen in this view is a possible form of low speed propulsion for the vehicle, as taked along the line 3—3 of FIG. 2;

FIG. 2 is a side view of the same possible embodiment of my novel high speed mass transportation vehicle;

FIG. 3 is another cross-sectional view of the same embodiment of my method of high speed mass transportation, both vehicle and track, the vehicle being in operating position on the track, and also seen in this view is a possible form of high speed propulsion for the vehicle, as taken aling line 5—5 of FIG. 2;

FIG. 4 is a cross sectional view of another possible embodiment of my method of high speed mass transportation, both vehicle and track, the vehicle being elevated above the track;

FIG. 5 is a side view of the same possible embodiment of my mass transportation vehicle;

FIG. 6 is a cross sectional view of the same possible embodiment of my novel high speed mass transportation track, and also shown is the general path water would take in the process of covering the track;

FIG. 7 is a side view of the same track as seen along the line 7—7 of FIG. 6;

FIG. 8 is a greatly reduced, and generally symbolic, side view of a possible path the track of FIG. 1 could take;

FIG. 9 is an enlargement of a liquid feeding assembly present on the track as shown in FIG. 8; and FIG. 10 is another enlargement of a liquid recieving assembly present on the track in FIG. 8.

DESCRIPTION OF THE PREFERRED EMBODIMENT

Referring to the drawing, and particularly FIG. 1, my improved method of high speed mass transportation, a possible embodiment of my high speed mass transportation vehicle, generally 20, is shown elevated above a possible form of my high speed track, generally 22. Also shown is a possible form of propulsion for the vehicle 20, as shown as a low speed engine 2, a low speed transmission 4, and a low speed driving wheel 6. Shown also is the vertical retaining walls 8, and the overhanging portion thereon 12.

Referring particularly to FIG. 2, a general view of a possible embodiment of my high speed mass transportaion vehicle 20, is shown, making visible one of the two low speed driving wheels 6, three of the six positioning wheels 14, and one of the two high speed driving wheels 16. Also made obvious is the flat and smooth nature of the vehicle's bottom supportive means 18.

Referring particularly to FIG. 3, a possible embodiment of the high speed propulsion setup is shown, wherein this setup would operate alternatly with the low speed propulsion setup as shown in FIG. 1. This high speed propulsion setup is shown as the high speed engine 60, the high speed transmission 62, and the high speed driving wheel 64. Also shown in FIG. 3 is how the high speed driving wheels 64, and consequently the low speed driving wheels 6 and positioning wheels 14, come into contact with the overhanging portion 12, of the vertical retaining wall 8.

Referring particularly to FIG. 4, another possible embodiment of the high speed mass transportation vehicle, generally 30, and track, generally 32, are shown. Also shown is a possible embodiment of the internally inflated supportive means 28, and of the vehicle 30. Also shown is the tube 34, which contains the liquid which coats the track 32. The liquid subsequently flows out the slit 36, which follows the lowest points of the track 32.

Referring particularly to FIG. 5, a view of vehicle 30 is shown which makes obvious a possible embodiment of the inflated supportive means 28, and vehicle 30.

Referring particularly to FIG. 6, the path the liquid 50 (not visible in other of these illustrations, and here only shown symbolically) follows is shown, wherein the liquid flows from tube 34 through liquid apertures 66 (as shown in FIG. 7), down the concave sides of track 32, and out the slit 36, where the liquid 50 is carried away by conduit 38.

Referring particularly to FIG. 7, a view is shown which makes obvious the position of the liquid apertures 66, which allow liquid from tube 34 to flow through the wall of tube 34 and through the wall of track 32, at approximately the positions shown.

Referring particularly to FIG. 8, shown are possible relative positions of the assemblies as shown in FIG. 9 and FIG. 10.

Referring particularly to FIG. 9, a view is shown of a liquid feeding assembly, generally 48', wherein liquid is fed to the water trough 52, which traverses the track 22, by way of the water conduit 54. The water in the trough flows evenly outward and downward, covering the track 22. Also, the still water on the level side of the track 22 is kept on the level side by the flexible vertical retaining wall 46, which traverses the track 22.

Referring particularly to FIG. 10, a liquid receiving assembly, generally 40', is shown, where the track 22 has a slit 42, which traverses the track 22, and the liquid from the liquid feeding assembly 48' subsequently falls through the slit 42, to where it is carried away via conduit 44. The still water on the level side of the track 22 is kept out of the slit 42 by the flexible vertical retaing wall 46.

While in the foregoing, there has been given a detailed description of two particular embodiments of the present invention, it is to be understood that all equivalents obvious to those having skill in the art to be included within the scope of the invention as claimed.

I claim:

1. A high speed mass transportation system comprising:

track means;

means mounted on said track means to cover said track means with a film of liquid;

a vehicle;

means for propelling said vehicle along said track means;

said vehicle including means for supporting said vehicle over said track means;

said means for supporting said vehicle over said track means conforming substantially with the shape of said track means at all points where said vehicle comes in or near contact with said track means;

and said means for supporting said vehicle over said track means and said track means are substantially smooth at all points where said means for supporting said vehicle and said track means meet.

2. A high speed mass transportation system as claimed in claim 1 wherein said means for supporting said vehicle over said track means and said track means are of a substantially flat design;

said track means being either level or sloped;

said means to cover said track means with a film of liquid including a trough traversing said track means at the highest point of said track means as seen from said trough in both directions;

a conduit leading from a source of liquid to said trough whereby said trough is kept full of liquid and whereby said liquid flows out from said trough into and down said track means thereby covering the track means located between consecutive sloped portions; and a slit traversing said track means at the lowest point of said track means through which said liquid is allowed to escape said track means.

3. A high speed mass transportation system as claimed in claim 1, wherein said track means and said means for supporting said vehicle over said track means are substantially U-shaped; and wherein said means to cover said track means with a film of liquid include:

a tube which follows the upper edges of said U-shaped track means and containing pressurized liquid; and small apertures spaced at short intervals along the length of said tube, said apertures leading from said tube to the inside surface of said U-shaped track means.

4. A high speed mass transportation system as claimed in claim 2, wherein on level portion of said track means the liquid is retained therein by a vertical flexible wall traversing said track means.

* * * * *